US007437979B1

(12) United States Patent
Wang

(10) Patent No.: US 7,437,979 B1
(45) Date of Patent: Oct. 21, 2008

(54) SCREWDRIVER BIT

(76) Inventor: Jui-Hsiao Wang, No. 50-1, Lane 60, Jian Pyng 9th St., Tainan (TW)

( * ) Notice: Subject to any disclaimer, the term of this patent is extended or adjusted under 35 U.S.C. 154(b) by 0 days.

(21) Appl. No.: 11/853,145

(22) Filed: Sep. 11, 2007

(51) Int. Cl.
*B25B 15/00* (2006.01)

(52) U.S. Cl. ..... 81/436

(58) Field of Classification Search ..... 81/436; D8/86

See application file for complete search history.

(56) References Cited

U.S. PATENT DOCUMENTS 4,102,375 A * 7/1978 Rossini ..... 81/30
4,703,677 A * 11/1987 Rossini ..... 81/471
7,267,034 B2 * 9/2007 Hsieh ..... 81/177.2

* cited by examiner

*Primary Examiner*—David B Thomas
(74) *Attorney, Agent, or Firm*—Alan Kamrath; Kamrath & Associates PA

(57) ABSTRACT

A screwdriver bit includes a shank for coupling with a tool for rotating the shank. An engaging portion extends from one of two ends of the shank and includes an insertion section for coupling with a fastener. A reduced, threaded section is formed between one of the ends of the shank and the insertion section of the engaging portion. The reduced, threaded section includes an outer diameter smaller than that of the ends of the shank and an outer threading. The outer threading of the reduced, threaded section provides uniform stress distribution during torque transmission.

3 Claims, 7 Drawing Sheets

SCREWDRIVER BIT

BACKGROUND OF THE INVENTION

The present invention relates to a screwdriver bit and, more particularly, to a screwdriver bit releasably coupled with a screwdriver for driving screws or the like.

Screwdriver bits releasably coupled with a screwdriver for driving screws or the like are well known and have various types such as rectilinear, cruciform, hexagonal, inner hexagonal, and ring shapes corresponding to various groove shapes in the screw heads.

FIG. 1 of the drawings illustrates a typical screwdriver bit 12 including a shank 121 releasably coupled with a socket 13. The bit 12 further includes an end 122 having an insertion portion 123 with a shape corresponding to that of a groove 21 in a head of a screw 2. The socket 13 is attached to a head 111 on an end of a handle 11 of a wrench 1 or a power tool (not shown). Releasable coupling between the bit 12 and the socket 13 allows a user to select a proper bit according to the type and size of the groove of the screw to be tightened or loosened.

In some bits, the cross sectional area of the insertion portion 123 is smaller than that of the shank 121 whose size is fixed for coupling with the socket 13. Stress concentration exists in a transition section 125 between a root section 124 of the end 122 of the bit 12. Breakage of the bit 12 in the transition section 125 may occur during operation, resulting in potential a hazard to the user.

It is, therefore, a need for a screwdriver bit with enhanced safety during use.

BRIEF SUMMARY OF THE INVENTION

The present invention solves this need and other problems in the field of screwdriver bits by providing, in a preferred form, a screwdriver bit including a shank adapted to releasably couple with a tool for rotating the shank. A first engaging portion extends from one of two ends of the shank and includes a first insertion section adapted for coupling with a fastener. A reduced, threaded section is formed between one of the ends of the shank and the first insertion section of the first engaging portion. The reduced, threaded section includes an outer diameter smaller than that of the ends of the shank and an outer threading. The outer threading of the reduced, threaded section provides uniform stress distribution during torque transmission to enhance use safety.

In an embodiment, the first engaging portion includes a root section contiguous to one of the ends of the shank. The root section has circular cross sections and forms the reduced, threaded section.

In another embodiment, a second engaging portion extends from the other end of the shank. The second engaging portion includes a second insertion section. Another reduced, threaded section is formed between the second insertion section and the other end of the shank and includes an outer diameter smaller than that of the shank and an outer threading.

In a further embodiment, the reduced threaded section is formed between the ends of the shank.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
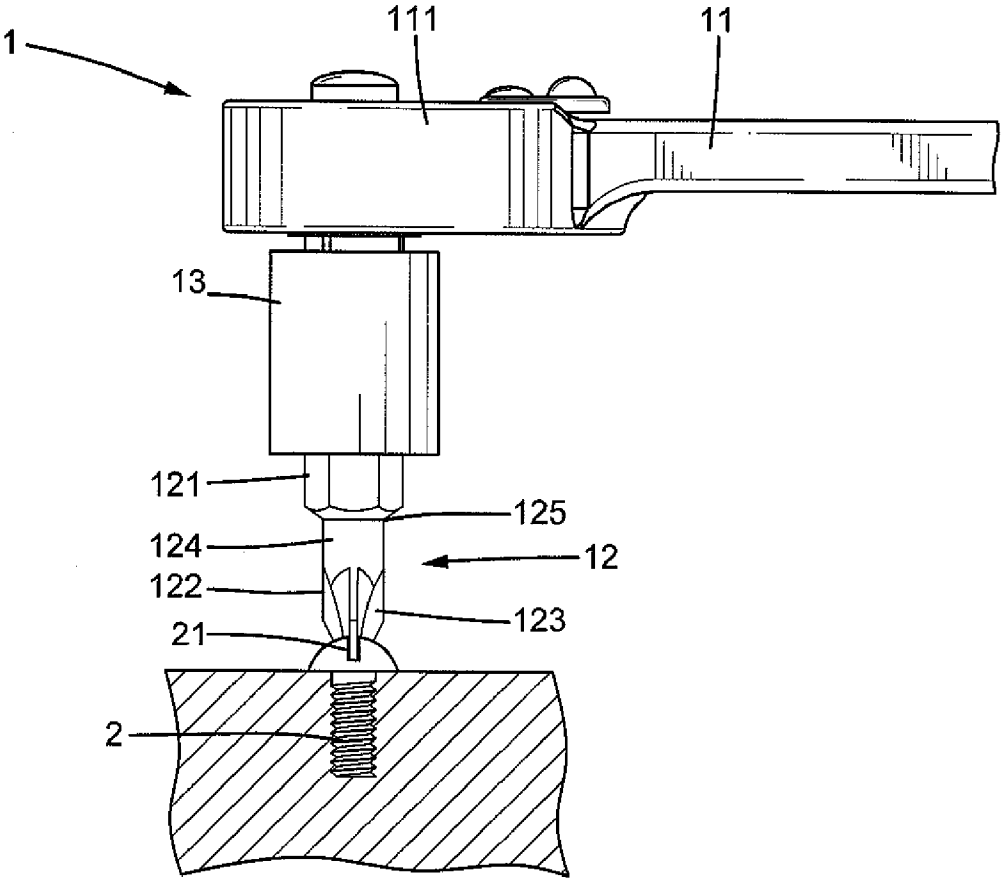
FIG.1 PRIOR ART
FIG. 1 shows a conventional screwdriver bit and a wrench for coupling with the conventional screwdriver bit.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "lower", "end", "portion", "section", "outward", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

Figure 2:
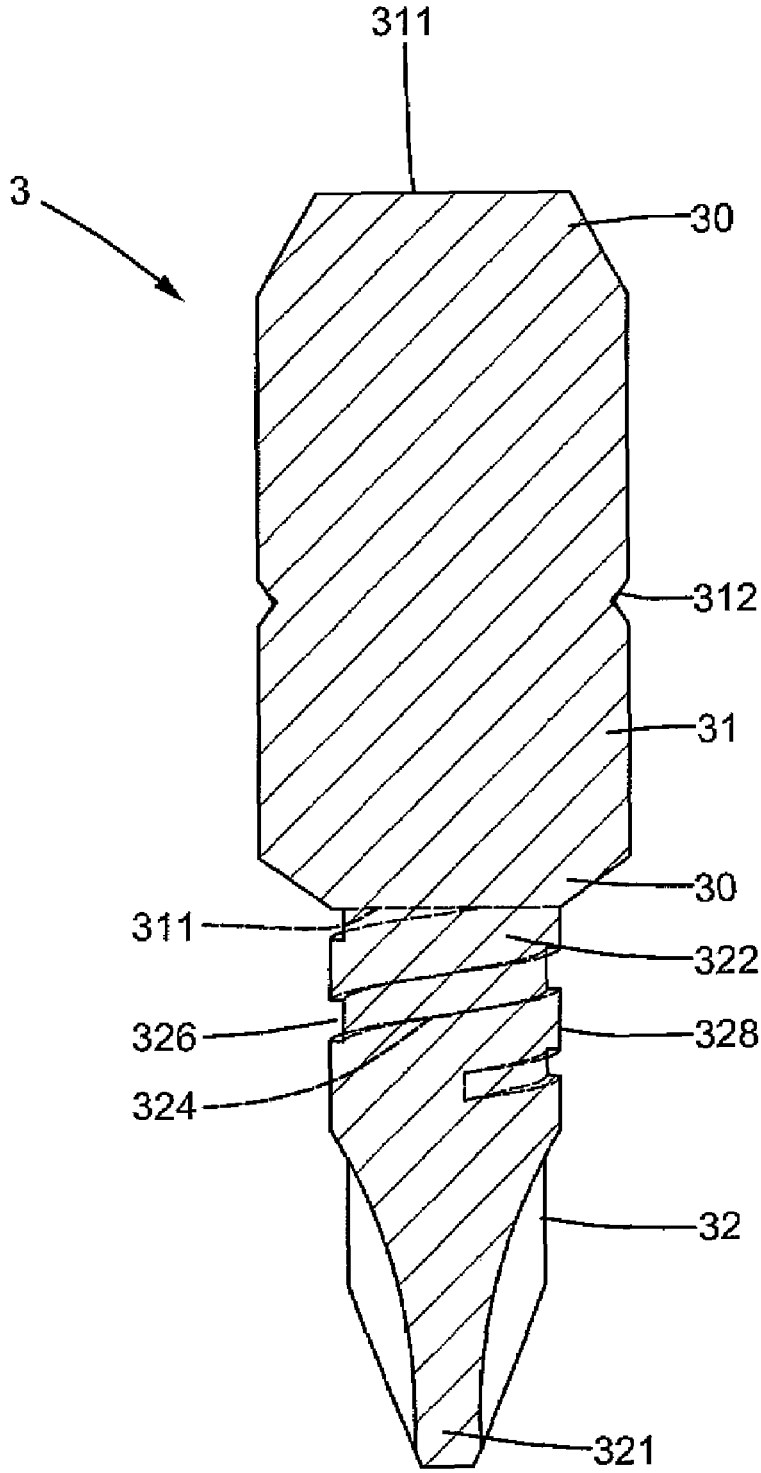
FIG. 2 shows a cross sectional view of a screwdriver bit of a first embodiment according to the preferred teachings of the present invention.
Figure 3:
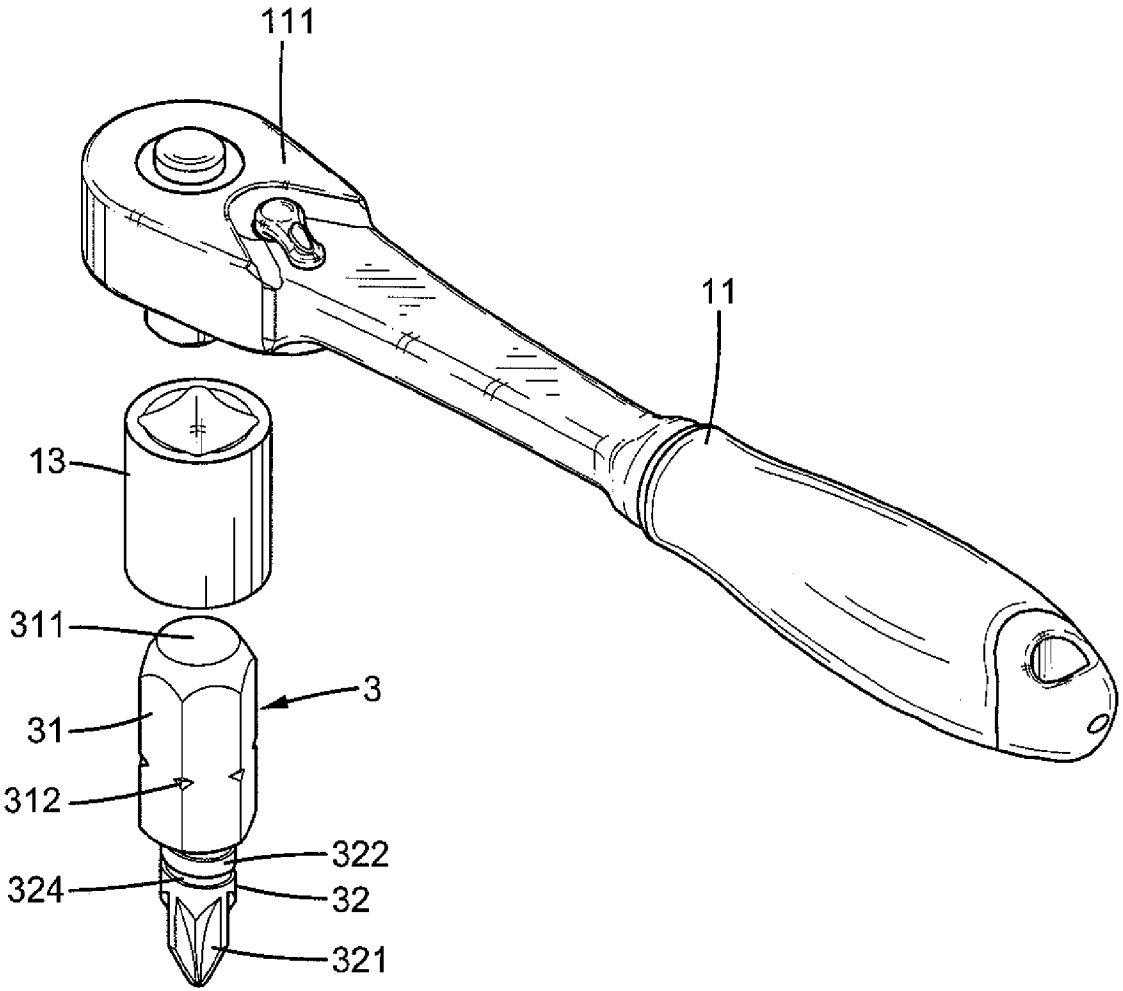
FIG. 3 shows an exploded perspective view of the screwdriver bit of FIG. 2 and a wrench for releasably coupling with the screwdriver bit.
Figure 4:
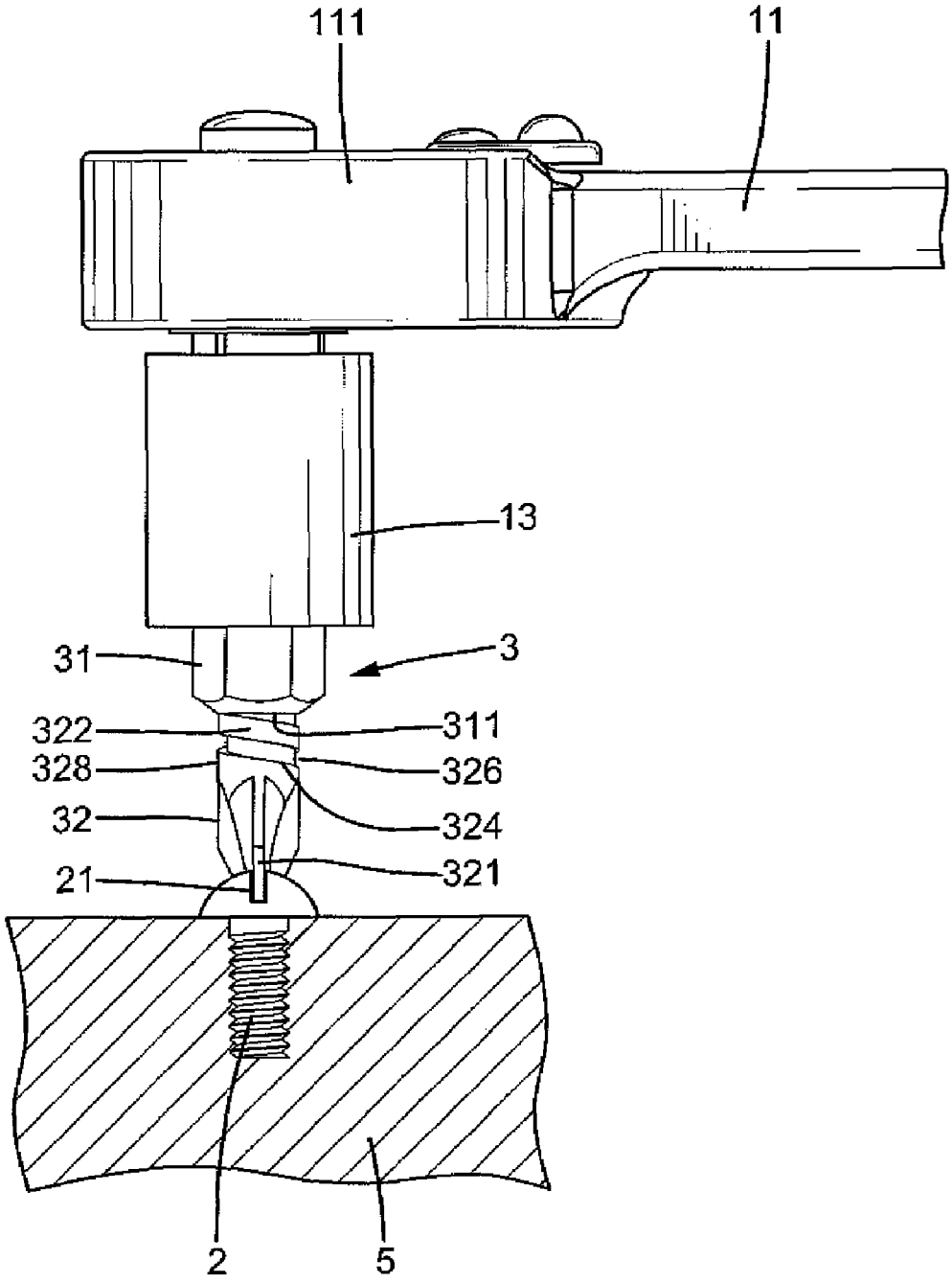
FIG. 4 is a cross sectional view illustrating use of the screwdriver bit and the wrench of FIG. 3.

A screwdriver bit of a first embodiment of according to the preferred teachings of the present invention is shown in FIGS. 2-4 of the drawings and generally designated 3. The screwdriver bit 3 is generally integrally formed of metal and includes a shank 31 and an engaging portion 32 extending from an end face 311 of an end 30 of the shank 31. According to the preferred form, the shank 31 has hexagonal cross sections for releasable coupling with a socket 13 of a head 111 of a wrench handle 11 that can be operated to rotate the shank 31. The shank 31 further includes a plurality of recesses 312 in an outer periphery thereof for coupling with a retainer (not shown) in the socket 13, allowing the shank 31 to be securely retained in the socket 13. The shank 31 can be coupled with tools of any desired form as conventional including but not limited to of a commercially available type.

The engaging portion 32 includes an insertion section 321 to be coupled with a groove 21 in a head of a fastener 2 such as a screw for driving or removing the fastener 2 into or from an object 5. In the illustrated embodiment, the insertion section 321 and the groove 21 are cruciform. It can be appreciated that other shapes of the insertion section 321 including but not limited to rectilinear, hexagonal, inner hexagonal, and ring shapes would be within the skill of the art.

Of more importance, a reduced, threaded section 328 is formed between an end 30 of the shank 31 and the insertion section 321 of the engaging portion 32 and has an outer diameter smaller than that of the shank 31. The threaded section 328 of the screwdriver bit 3 includes an outer threading 324 formed on an outer periphery thereof and having at least one screw thread. This provides a uniform stress distribution in the reduced, threaded section 328 during torque transmission at the screwdriver bit 3. Specifically, the groove 326 of the reduced, threaded section 328 is the place where the reactive force acts during operation, and the reactive force is uniformly distributed on the reduced, threaded section 328 along the outer threading 324. Stress concentration of the screwdriver bit 3 is mitigated, and the life of the screwdriver bit 3 is prolonged. According to the preferred form shown, the threaded section 328 is formed on a root section 322 of the engaging portion 32 that is contiguous to the end face 311 of the shank 31 and that has circular cross sections. According to test results, the screwdriver bit 3 according to the preferred teachings of the present invention merely deformed under a stress that caused breakage of the conventional screwdriver bit 12 of FIG. 1. Improved use safety is, thus, provided.

Figure 5:
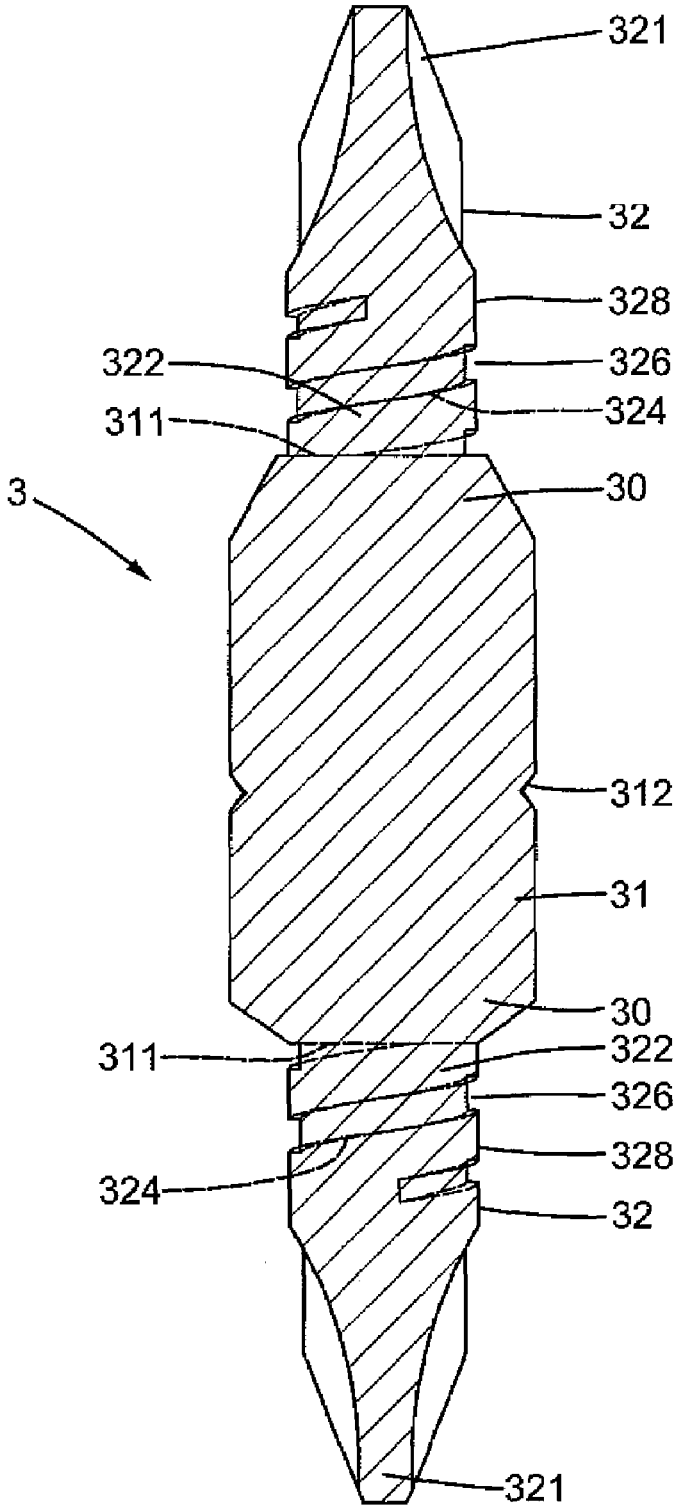
FIG. 5 shows a cross sectional view of a screwdriver bit of a second embodiment according to the preferred teachings of the present invention.

FIG. 5 shows a screwdriver bit 3 of a second embodiment according to the preferred teachings of the present invention. In the screwdriver bit 3 of FIG. 5, an engaging portion 32 extends from each of two ends 30 of the shank 31. According to the preferred form shown, each engaging portion 32 of FIG. 5 is identical to the engaging portion 32 of FIGS. 2-4. The outer threading 324 on the reduced, threaded section 328 of each engaging portion 32 of the screwdriver bit 3 of FIG. 5 provides the same advantages as those of the engaging portion 32 of the screwdriver bit 3 of FIGS. 2-4. Detailed descriptions of the engaging portions 32 of FIG. 5 are omitted to avoid redundancy.

Figure 6:
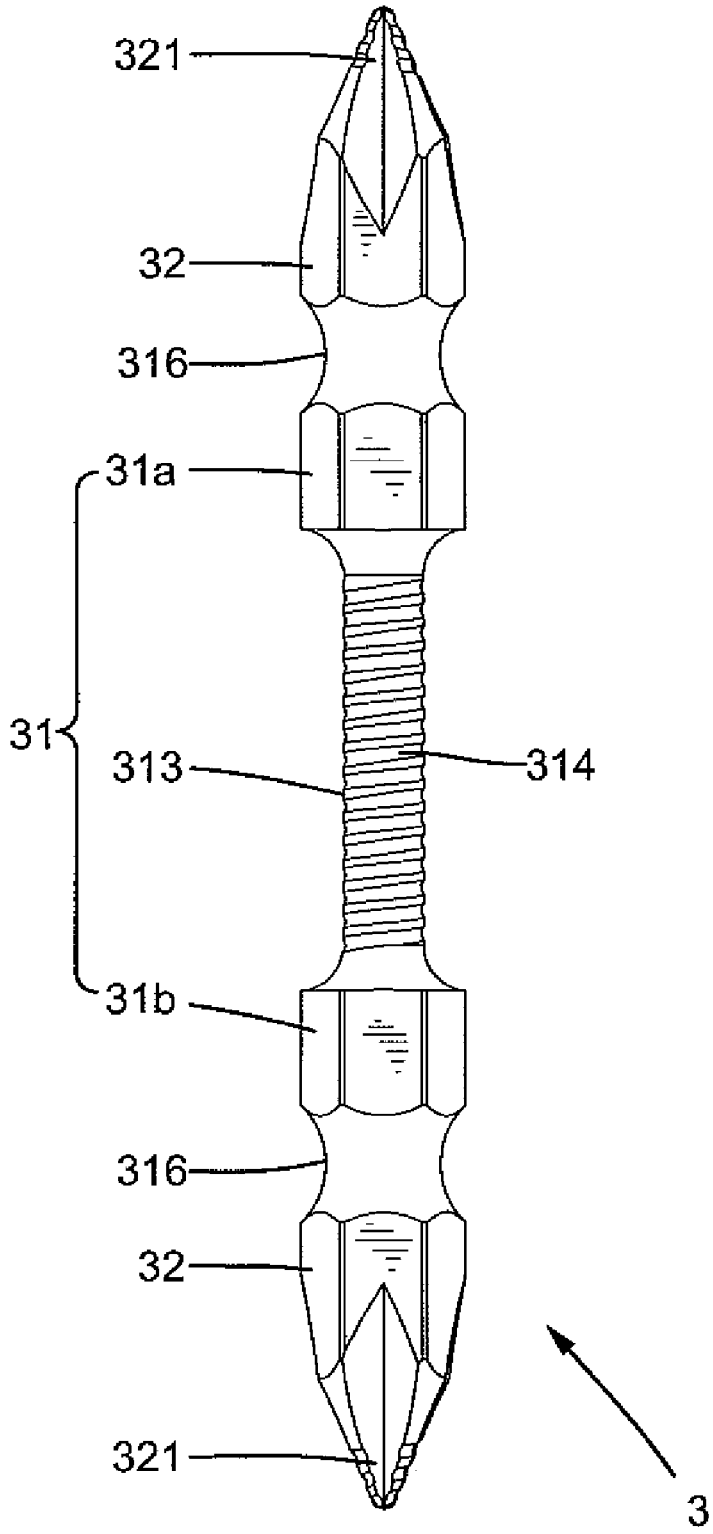
FIG. 6 shows an elevational view of a screwdriver bit of a third embodiment according to the preferred teachings of the present invention.
Figure 7:
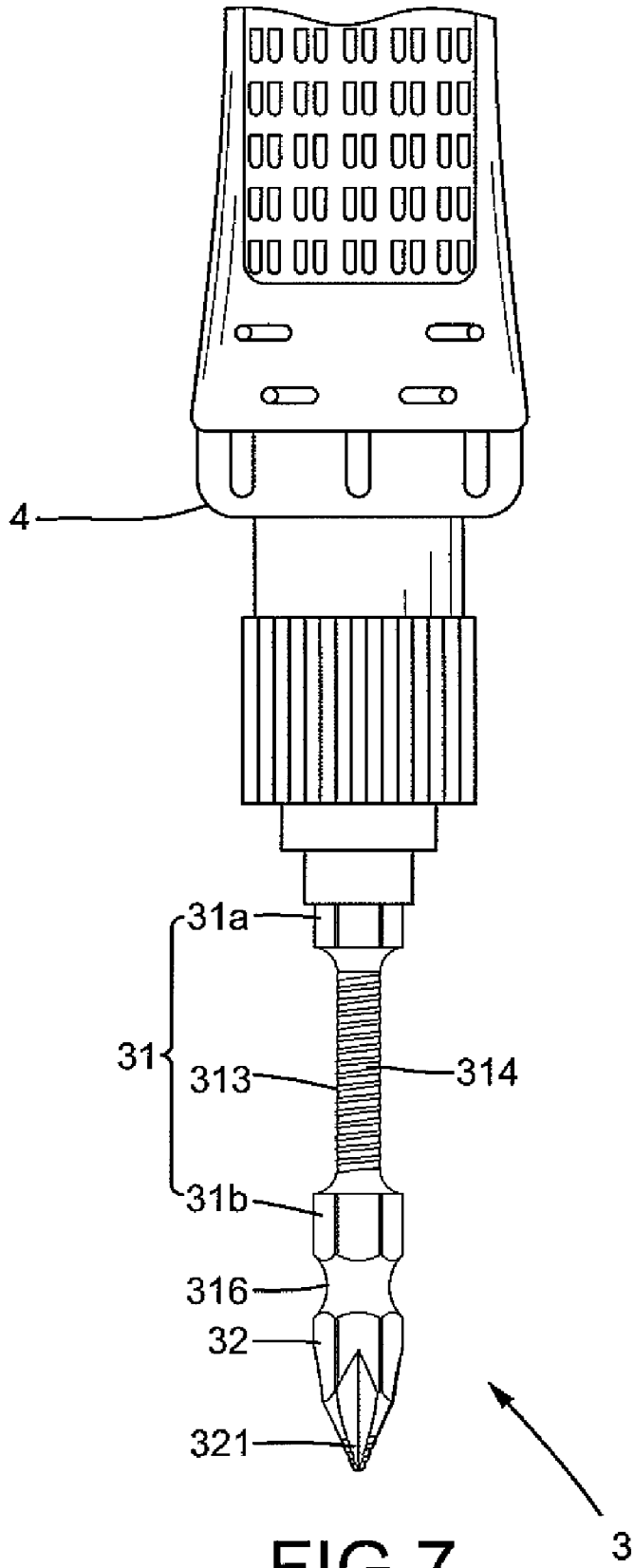
FIG. 7 shows use of the screwdriver bit of FIG. 6 with a power tool.

FIGS. 6-7 show a screwdriver bit 3 of a third embodiment according to the preferred teachings of the present invention. The screwdriver bit 3 of FIGS. 6 and 7 is substantially the same as that of FIG. 5 except that the shank 31 of FIGS. 6 and 7 is longer for use with a power tool 4. Specifically, the shank 31 includes first and second ends 31*a* and 31*b* and two engaging portions 32 respectively extending outward from the first and second ends 31*a* and 31*b*. A reduced, threaded section 313 is interconnected between the first and second ends 31*a* and 31*b*. The reduced, threaded section 313 has an outer diameter smaller than that of each engaging portion 32 and smaller than that of the first and second ends 31*a* and 31*b* of the shank 31. Furthermore, the reduced, threaded section 313 includes an outer threading 314. Further, an engaging groove 316 is formed between each end 31*a*, 31*b* of the shank 31 and an adjacent engaging portion 32 for coupling with the power tool 4. By such an arrangement, when the end 31*a* of the shank 31 is coupled with the power tool 4 (see FIG. 7), the reduced, threaded section 313 is located between the shank 31*a* and one of the engaging portions 32 (the lower one in FIG. 7). On the other hand, when the other end 31*b* of the shank 31 is coupled with the power tool 4, the reduced, threaded section 313 is located between the other end 31*b* of the shank 31 and the other engaging portion 32. In use, breakage of the reduced, threaded section 313 is avoided by the outer threading 314 that mitigates stress concentration during torque transmission of the screwdriver bit 3. Improved use safety is, thus, provided. It can be appreciated that each engaging portion 32 may include an outer threading if desired.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A screwdriver bit comprising:

a shank adapted to releasably couple with a tool for rotating the shank, with the shank including two ends;

a first engaging portion extending from one of the ends of the shank, with the first engaging portion including a first insertion section adapted for coupling with a fastener; and a reduced, threaded section formed between one of the ends of the shank and the first insertion section of the first engaging portion, with the reduced, threaded section including an outer diameter smaller than that of the ends of the shank, and with the threaded section including an outer threading;

with the first engaging portion including a root section contiguous to one of the ends of the shank, and with the root section having circular cross sections and forming the reduced, threaded section.

2. A screwdriver bit comprising:

a shank adapted to releasably couple with a tool for rotating the shank, with the shank including two ends;

a first engaging portion extending from one of the ends of the shank, with the first engaging portion including a first insertion section adapted for coupling with a fastener;

a reduced, threaded section formed between one of the ends of the shank and the first insertion section of the first engaging portion, with the reduced, threaded section including an outer diameter smaller than that of the ends of the shank, and with the threaded section including an outer threading; and a second engaging portion extending from the other end of the shank, with the second engaging portion including a second insertion section, with another reduced, threaded section being formed between the second insertion section and the other end of the shank and including an outer diameter smaller than that of the shank, and with the other threaded section including an outer threading.

3. A screwdriver bit comprising:

a shank adapted to releasably couple with a tool for rotating the shank, with the shank including two ends;

a first engaging portion extending from one of the ends of the shank, with the first engaging portion including a first insertion section adapted for coupling with a fastener; and a reduced, threaded section formed between one of the ends of the shank and the first insertion section of the first engaging portion, with the reduced, threaded section including an outer diameter smaller than that of the ends of the shank, and with the threaded section including an outer threading;

with the reduced threaded section being formed between the ends of the shank.

* * * * *